US006304183B1

(12) United States Patent
Causey

(10) Patent No.: US 6,304,183 B1
(45) Date of Patent: Oct. 16, 2001

(54) SUITCASE LOCATING DEVICE

(76) Inventor: Charles O. Causey, 17757 14th Ave. NW., Seattle, WA (US) 98177

( * ) Notice: Subject to any disclaimer, the term of this patent is extended or adjusted under 35 U.S.C. 154(b) by 0 days.

(21) Appl. No.: 09/737,793

(22) Filed: Dec. 15, 2000

(51) Int. Cl.[7] ..... G08B 13/14

(52) U.S. Cl. ..... 340/572.1; 340/568.1; 340/539; 340/571; 340/825.49; 340/825.36

(58) Field of Search ..... 340/572.1, 568.1, 340/539, 571, 825.49, 815.45, 10.1, 10.51, 10.52

(56) References Cited

U.S. PATENT DOCUMENTS

| | | | | |
|---|---|---|---|---|
| 3,695,462 | | 10/1972 | Sullivan | 414/273 |
| 4,065,343 | * | 12/1977 | Stumpe | 156/212 |
| 4,634,849 | | 1/1987 | Klingen | 235/487 |
| 5,012,077 | | 4/1991 | Takano | 235/380 |
| 5,126,719 | | 6/1992 | De Sorbo | 340/571 |
| 5,406,263 | * | 4/1995 | Tuttle | 340/572.1 |
| 5,510,768 | * | 4/1996 | Mann | 340/571 |
| 5,541,577 | * | 7/1996 | Cooper et al. | 340/551 |
| 5,646,592 | | 7/1997 | Tuttle | 340/572.1 |
| 5,781,150 | | 7/1998 | Norris | 342/357 |
| 5,835,013 | * | 11/1998 | Duterte | 340/539 |
| 5,920,053 | * | 7/1999 | DaBrouse | 235/375 |
| 5,963,131 | * | 10/1999 | D'Angelo et al. | 340/568.1 |
| 6,127,920 | * | 10/2000 | Chen | 340/425.5 |
| 6,133,832 | * | 10/2000 | Winder et al. | 340/572.1 |
| 6,147,602 | * | 11/2000 | Bender | 340/568.1 |
| 6,166,652 | * | 12/2000 | Benvenuti | 340/825.49 |
| 6,181,246 | * | 1/2001 | Ewing et al. | 340/571 |
| 6,184,789 | * | 2/2001 | Richley et al. | 340/571 |
| 6,198,390 | * | 3/2001 | Schlanger et al. | 340/540 |

* cited by examiner

*Primary Examiner*—Daniel J. Wu
*Assistant Examiner*—Toan Pham

(57) ABSTRACT

A suitcase locating device for quickly finding luggage in an airport luggage pick-up area. The suitcase locating device includes a housing. The housing has a top surface, a bottom surface, a front side, a back side, a first side wall and a second side wall. The housing is generally hollow. The top surface has a plurality of bar code indicia thereon. The bar code indicia is unique to the housing. A microprocessor actuates a plurality of lights and decodes a received signal. The microprocessor is securably mounted in the housing. A power supply for powering the microprocessor is operationally coupled to the microprocessor. Each of a plurality of lights is mounted in and is generally flush with the top surface of the housing. Each of the lights is electrically coupled to the microprocessor. A receiving means for receiving a signal is securely positioned in the housing and operationally coupled to the microprocessor. Each of a pair of straps for removably placing around a suitcase has a first end and a second end. Each of the first ends is securely attached to the first side wall, and each of the second ends is attached to the second side wall. An actuating means for sending a signal to the receiving means is adapted for selectively turning the lights on and off. The actuating means comprises a remote control device.

15 Claims, 6 Drawing Sheets

SUITCASE LOCATING DEVICE

BACKGROUND OF THE INVENTION

1. Field of the Invention

The present invention relates to luggage locating devices and more particularly pertains to a new suitcase locating device for quickly finding luggage in an airport luggage pick-up area.

2. Description of the Prior Art

The use of luggage locating devices is known in the prior art. More specifically, luggage locating devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,634,849; 3,695,462; 5,781,150; 5,646,592; 5,012,077; and 5,126,719.

While these devices fulfill their respective, particular objectives and requirements, the aforementioned patents do not disclose a new suitcase locating device. The inventive device includes a housing. The housing has a top surface, a bottom surface, a front side, a back side, a first side wall and a second side wall. The housing is generally hollow. The top surface has a plurality of bar code indicia thereon. The bar code indicia is unique to the housing. A microprocessor actuates a plurality of lights and decodes a received signal. The microprocessor is securable mounted in the housing. A power supply for powering the microprocessor is operationally coupled to the microprocessor. Each of a plurality of lights is mounted in and is generally flush with the top surface of the housing. Each of the lights is electrically coupled to the microprocessor. A receiving means for receiving a signal is securely positioned in the housing and operationally coupled to the microprocessor. Each of a pair of straps for removably placing around a suitcase has a first end and a second end. Each of the first ends is securely attached to the first side wall, and each of the second ends is attached to the second side wall. An actuating means for sending a signal to the receiving means is adapted for selectively turning the lights on and off. The actuating means comprises a remote control device.

In these respects, the suitcase locating device according to the present invention substantially departs from the conventional concepts and designs of the prior art, and in so doing provides an apparatus primarily developed for the purpose of quickly finding luggage in an airport luggage pick-up area.

SUMMARY OF THE INVENTION

In view of the foregoing disadvantages inherent in the known types of luggage locating devices now present in the prior art, the present invention provides a new suitcase locating device construction wherein the same can be utilized for quickly finding luggage in an airport luggage pick-up area.

The general purpose of the present invention, which will be described subsequently in greater detail, is to provide a new suitcase locating device apparatus and method which has many of the advantages of the luggage locating devices mentioned heretofore and many novel features that result in a new suitcase locating device which is not anticipated, rendered obvious, suggested, or even implied by any of the prior art luggage locating devices, either alone or in any combination thereof.

To attain this, the present invention generally comprises a housing. The housing has a top surface, a bottom surface, a front side, a back side, a first side wall and a second side wall. The housing is generally hollow. The top surface has a plurality of bar code indicia thereon. The bar code indicia is unique to the housing. A microprocessor actuates a plurality of lights and decodes a received signal. The microprocessor is securable mounted in the housing. A power supply for powering the microprocessor is operationally coupled to the microprocessor. Each of a plurality of lights is mounted in and is generally flush with the top surface of the housing. Each of the lights is electrically coupled to the microprocessor. A receiving means for receiving a signal is securely positioned in the housing and operationally coupled to the microprocessor. Each of a pair of straps for removably placing around a suitcase has a first end and a second end. Each of the first ends is securely attached to the first side wall, and each of the second ends is attached to the second side wall. An actuating means for sending a signal to the receiving means is adapted for selectively turning the lights on and off. The actuating means comprises a remote control device.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new suitcase locating device apparatus and method which has many of the advantages of the luggage locating devices mentioned heretofore and many novel features that result in a new suitcase locating device which is not anticipated, rendered obvious, suggested, or even implied by any of the prior art luggage locating devices, either alone or in any combination thereof.

It is another object of the present invention to provide a new suitcase locating device which may be easily and efficiently manufactured and marketed.

It is a further object of the present invention to provide a new suitcase locating device which is of a durable and reliable construction.

An even further object of the present invention is to provide a new suitcase locating device which is susceptible of a low cost of manufacture with regard to both materials and labor, and which accordingly is then susceptible of low prices of sale to the consuming public, thereby making such suitcase locating device economically available to the buying public.

Still yet another object of the present invention is to provide a new suitcase locating device which provides in the apparatuses and methods of the prior art some of the advantages thereof, while simultaneously overcoming some of the disadvantages normally associated therewith.

Still another object of the present invention is to provide a new suitcase locating device for quickly finding luggage in an airport luggage pick-up area.

Yet another object of the present invention is to provide a new suitcase locating device which includes a housing. The housing has a top surface, a bottom surface, a front side, a back side, a first side wall and a second side wall. The housing is generally hollow. The top surface has a plurality of bar code indicia thereon. The bar code indicia is unique to the housing. A microprocessor actuates a plurality of lights and decodes a received signal. The microprocessor is securable mounted in the housing. A power supply for powering the microprocessor is operationally coupled to the microprocessor. Each of a plurality of lights is mounted in and is generally flush with the top surface of the housing. Each of the lights is electrically coupled to the microprocessor. A receiving means for receiving a signal is securely positioned in the housing and operationally coupled to the microprocessor. Each of a pair of straps for removably placing around a suitcase has a first end and a second end. Each of the first ends is securely attached to the first side wall, and each of the second ends is attached to the second side wall. An actuating means for sending a signal to the receiving means is adapted for selectively turning the lights on and off. The actuating means comprises a remote control device.

Still yet another object of the present invention is to provide a new suitcase locating device that allows a user to easily locate baggage in baggage pick-up area by using lights to show the user that their luggage is passing by. This also speeds up the process of verifying that the true owner is indeed collecting the luggage.

Even still another object of the present invention is to provide a new suitcase locating device that has security measures therein for preventing tampering with a suitcase.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
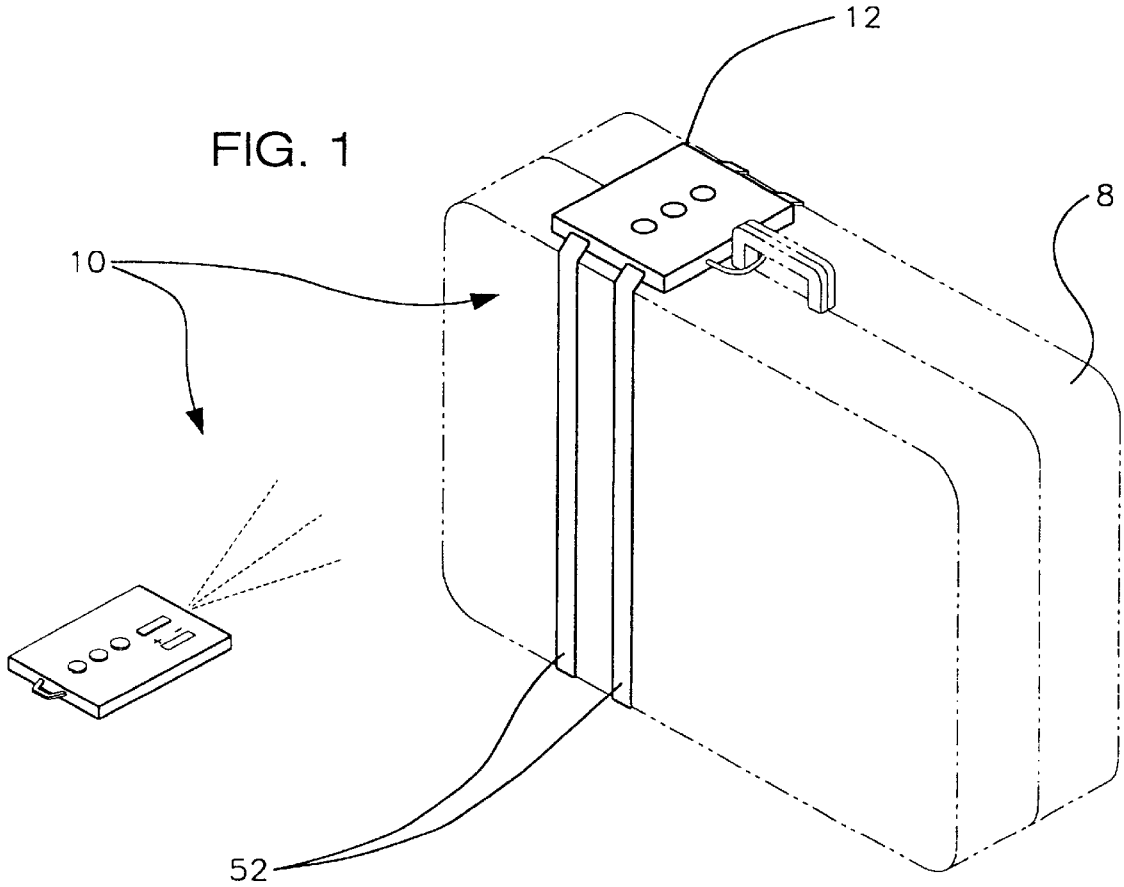
FIG. 1 is a schematic perspective view of a new suitcase locating device according to the present invention.
Figure 2:
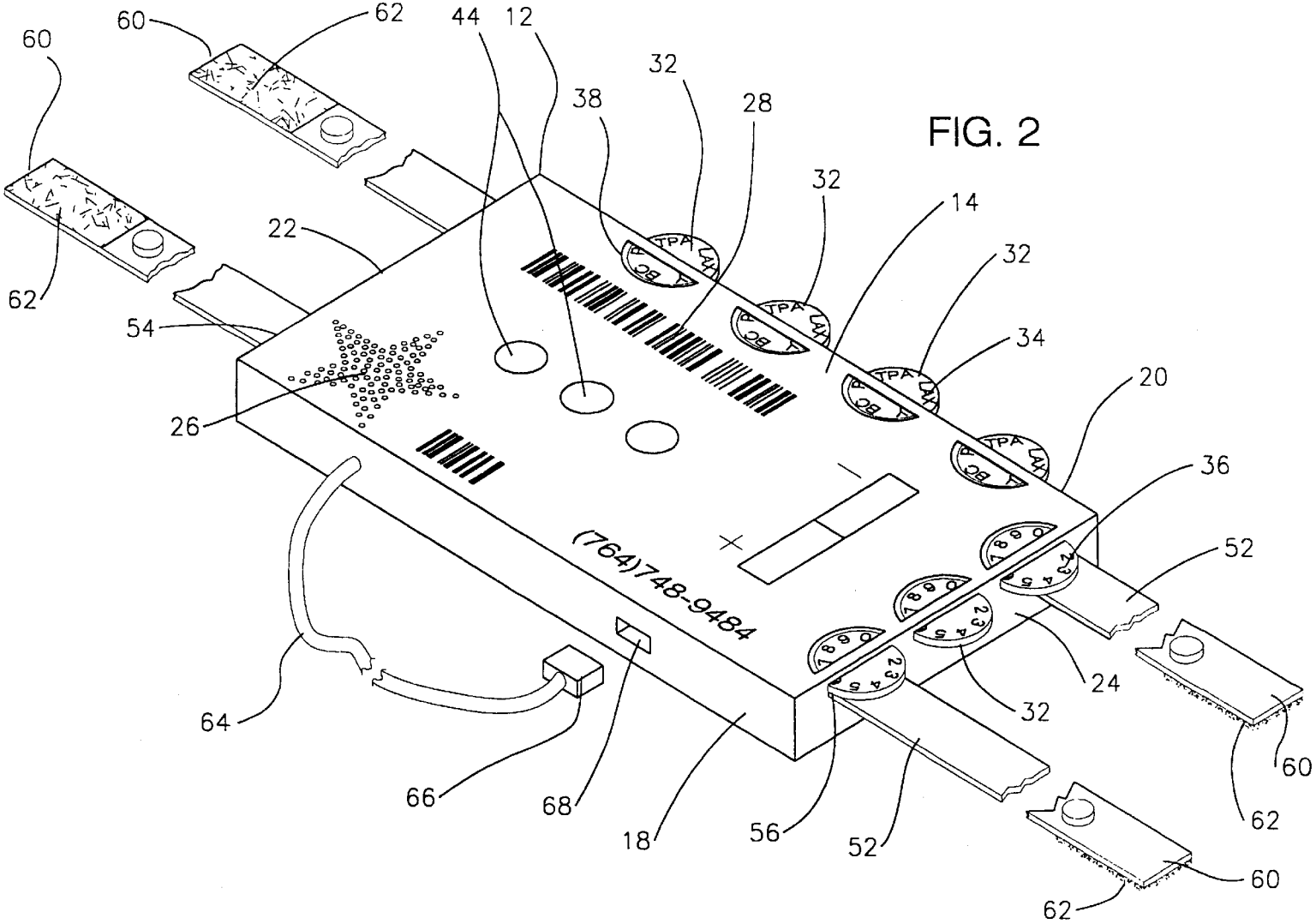
FIG. 2 is a schematic perspective view of the present invention.
Figure 3:
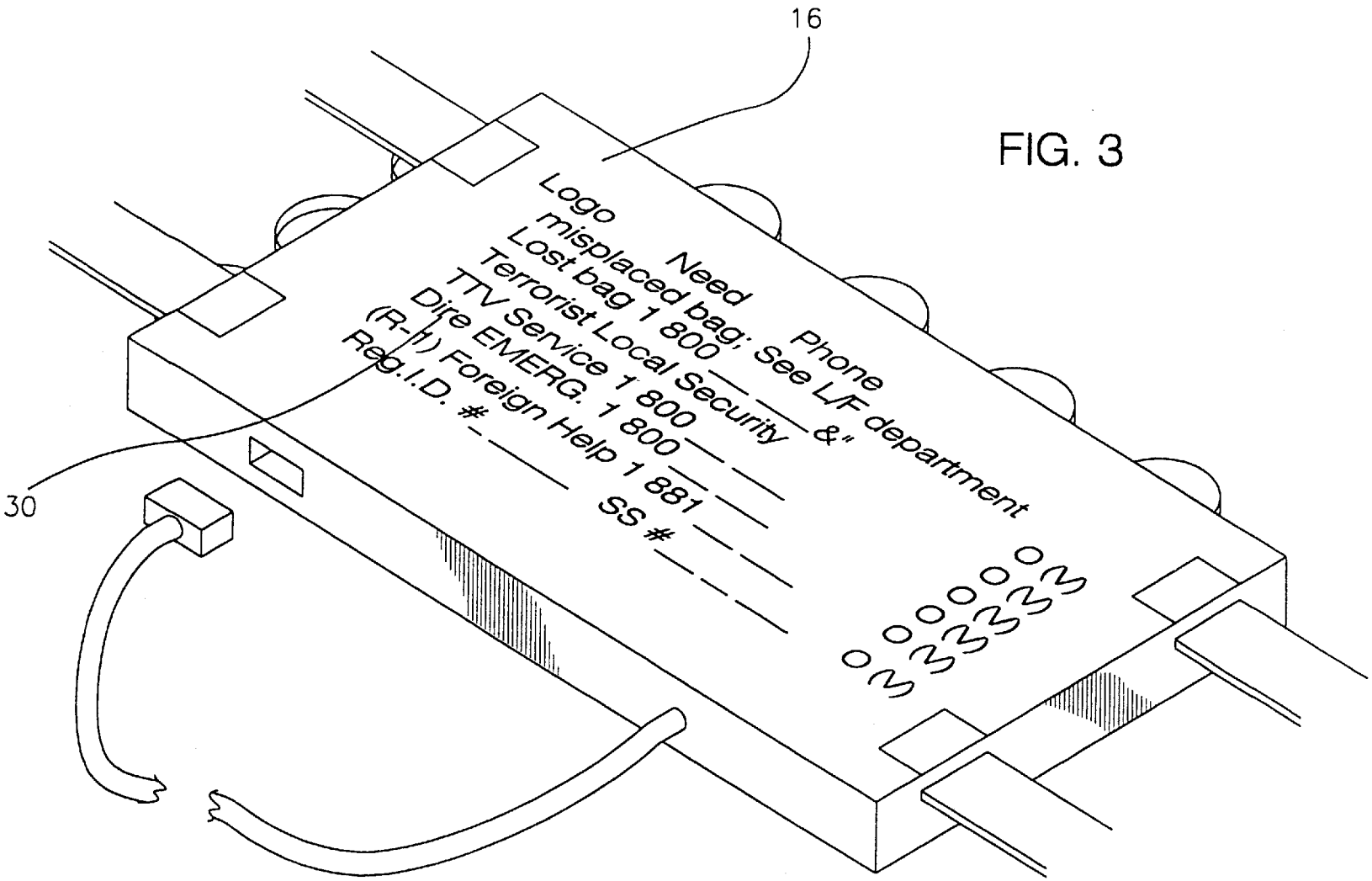
FIG. 3 is a schematic perspective view of the present invention.
Figure 4:
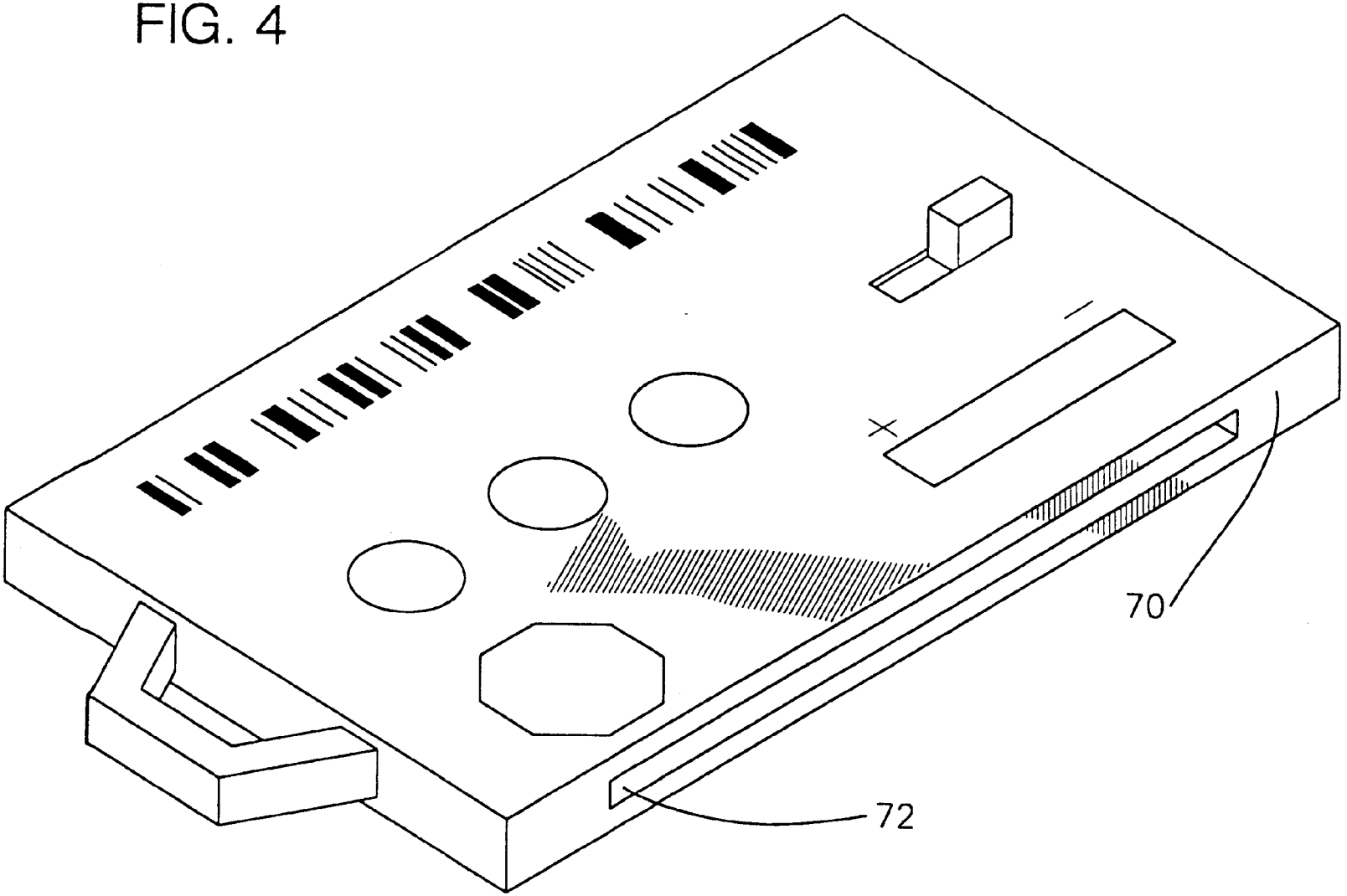
FIG. 4 is a schematic perspective view of the actuating means of the present invention.
Figure 5:
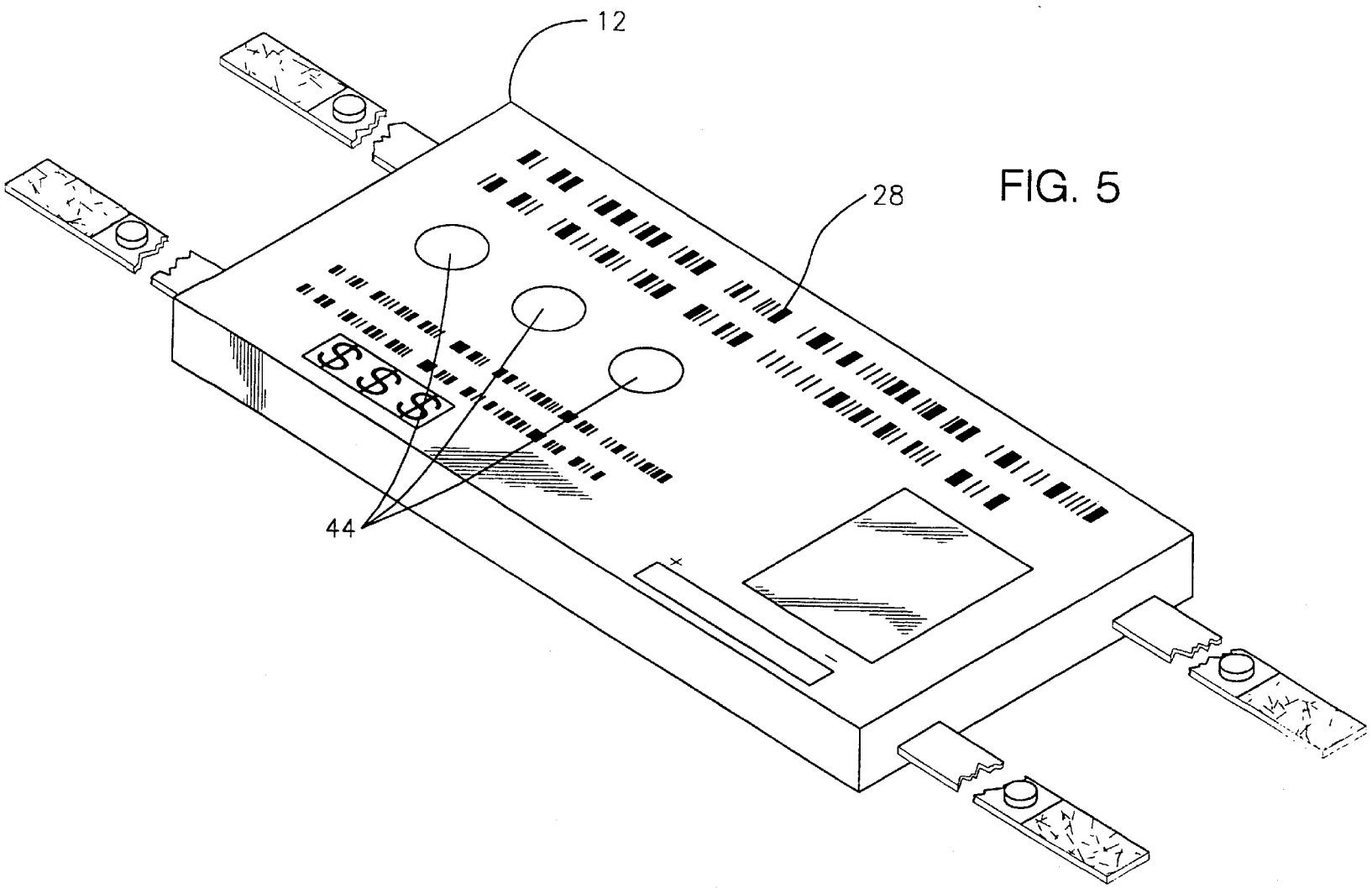
FIG. 5 is a schematic perspective back view of the present invention.
Figure 6:
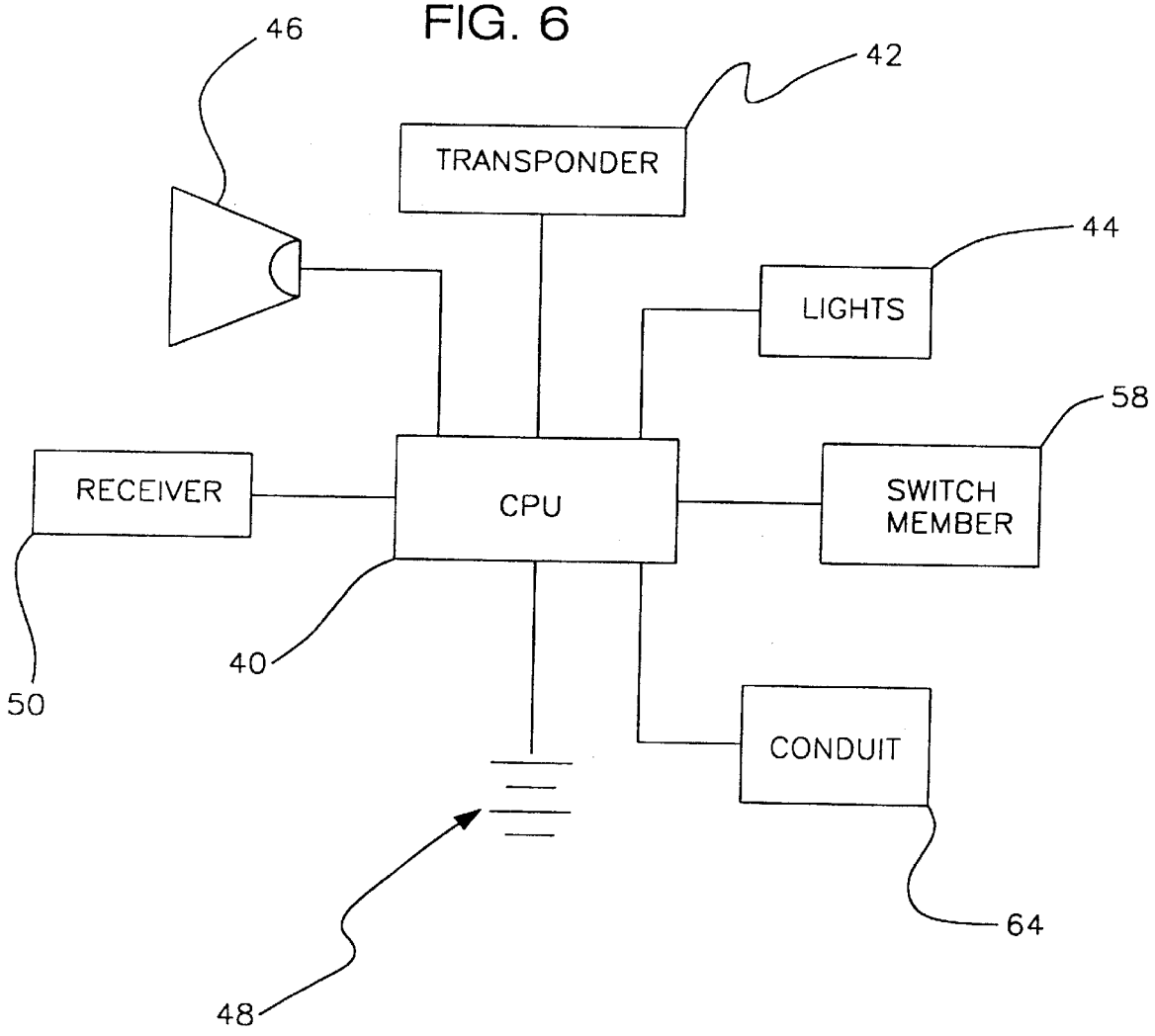
FIG. 6 is an electronic schematic view of the present invention.

With reference now to the drawings, and in particular to FIGS. 1 through 6 thereof, a new suitcase locating device embodying the principles and concepts of the present invention and generally designated by the reference numeral 10 will be described.

As best illustrated in FIGS. 1 through 6, the suitcase locating device 10 generally comprises a housing 12. The housing has a top surface 14, a bottom surface 16, a front side 18, a back side 20, a first side wall 22 and a second side wall 24. The housing 12 is generally hollow. The top surface 14 of the housing 12 has a plurality of holes 26 extending therethrough. The top surface 14 has a plurality of bar code indicia 28 thereon. The bar code indicia 28 is unique to the housing 12. A scanner at an airport check-in may read the bar code so that a typical destination tag need not be placed on a suitcase 8. The suitcase 8 may also be tracked in this manner by checkpoints along the route to ensure the suitcase 8 is where it is supposed to be. The back surface 16 has personal information indicia 30 thereon so that a person may write their personal information thereon.

Each of a plurality of dials 32 is rotatably coupled to a peripheral edge of the housing 12. Each of the dials 32 has airport indicia 34 thereon for indicating a plurality of airports and flight numbers 36. Each of the dials 32 has a window 38 associated therewith extending through the top surface 14 for viewing the indicia selected. The dials 32 may be used if the airport is not equipped for scanning the bar code 28.

A microprocessor 40 is adapted for sending a signal to a transponder 42, for actuating a plurality of lights 44, for sending a sound signal to a speaker 46, and for decoding a received signal. The microprocessor 40 is securable mounted in the housing 12.

A power supply 48 for powering the microprocessor 40 is operationally coupled to the microprocessor. The power supply 48 is positioned in the housing 12. The power supply 48 preferably comprises a battery.

A speaker 46 for emitting a sound is securely mounted in the housing 12 and is positioned generally adjacent to the holes 26 in the top surface.

Each of a plurality of lights 44 is mounted in and is generally flush with the top surface 14 of the housing 12. Each of the lights 44 is electrically coupled to the microprocessor 40. Each of the lights has a different color.

A receiving means 50 for receiving a signal is securely positioned in the housing 12 and is operationally coupled to the microprocessor 40.

A transponder 42 for sending a signal is securely mounted in the housing 12 and operationally coupled to the microprocessor 40. The transponder 42 is adapted for emitting a unique signal for locating the housing 12. The transponder 42 is a conventional transponder generally used for locating stolen cars using a radio signal which is caused to be turned on by sending a signal to the microprocessor 40.

A first security device includes a pair of straps 52. Each of the straps 52 has a first end 54 and a second end 56. Each of the first ends 54 is securely attached to the first side wall 22. Each of the second ends 56 movably extends through the second side wall 24. A switch member 58 is positioned in the housing 12 and is securely attached to each of the second ends 56 of the straps 52. The switch member 58 is operationally coupled to the microprocessor. Slack in the straps 52 actuates the switch member 58. Each of the straps 52 is preferably resiliently elastic. Each of the straps 52 has a break 60 therein such that each of the straps has a first portion and a second portion removably coupled together with a fastening means 62. The fastening means 62 preferably comprises a hook and loop fastening means. The straps 52 are placeable around the suitcase 8 and hold the housing 12 to the suitcase.

A second security device comprises a circuit. The circuit includes a conduit 64 extending outwardly of the housing 12. The conduit 64 has a first end operationally coupled to the microprocessor 40 and a second end has a male plug 66 electrically coupled thereto. The male plug 66 is removably insertable into a female plug 68 extending into the front side 18 of the housing 12. The female plug 68 is operationally coupled to the microprocessor 40.

An actuating means 70 sends a signal to the receiving means 50. The actuating means 70 is adapted for selectively turning the first and second security devices on and off and for turning the lights on and off. The speaker 46 will sound an alarm if the first security device is turned on and the straps 52 are removed from the suitcase 8 so that there is slack in the straps 52. The speaker 46 sounds an alarm if the second security device is turned on and the circuit is broken by the removal of the male plug from the female plug or if the conduit 64 is cut. The actuating means 70 comprises a remote control device.

Also envisioned by the applicant is a storage slot 72 in the actuating means 70 for removably receiving a card resembling a conventional credit card. The card could be used as a credit card having, as well as having information regarding a user's health. The bar-coding on the card could also contain information matching the holder of the card with the owner of the housing 12. This information could be scanned as a person boards a plane and re-scanned during departing to confirm the suitcase belongs to the user.

In use, the main feature of the device is a visual locator for finding luggage as it is in the luggage pick-up area at an airport. Often luggage looks similar and it is difficult to find. The actuating means sends a signal to the microprocessor to turn the lights on. The lights are different colors, which are randomly positioned and colored so that two housings may have different light patterns. The actuating means is similar to those used for keyless entry for automobiles. The lights help a user to locate the luggage as it passes by on the baggage pick-up.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A suitcase location and security system, said system being removably mountable to a suitcase and a handle thereof, said system comprising:

a housing, said housing having a top surface, a bottom surface, a front side, a back side, a first side wall and a second side wall, said housing being generally hollow, said top surface having a plurality of bar code indicia thereon, said bar code indicia being unique to said housing;

a microprocessor, for actuating a plurality of lights and for decoding a received signal, said microprocessor being securably mounted in said housing;

a power supply for powering said microprocessor, said power supply being operationally coupled to said microprocessor;

a plurality of lights, each of said lights being mounted in and being generally flush with said top surface of said housing, each of said lights being electrically coupled to said microprocessor;

a receiving means for receiving a signal, said receiving means being securely positioned in said housing and operationally coupled to said microprocessor;

a means for coupling said housing to said suitcase;

an actuating means for sending a signal to said receiving means, said actuating means being adapted for selectively turning said lights on and off, said actuating means comprising a remote control device; and a plurality of dials, each of said dials being rotatably coupled to a peripheral edge of said housing, each of said dials having airport indicia thereon for indicating a plurality of airports and flight numbers, each of said dials having a window associated therewith extending through said top surface.

2. The suitcase location and security system as in claim 1, wherein said means for coupling said housing to said suitcase comprises:

a pair of straps for removably placing around the suitcase, each of said straps having a first end and a second end, each of said first ends being securely attached to said first side wall, each of said second ends being attached to said second side wall.

3. The suitcase location and security system as in claim 2, wherein said system further includes:

a speaker for emitting a sound, said speaker being mounted on said housing;

each of said second ends of said straps movably extending through said second side wall, a switch member being positioned in said housing and securely attached to each of said second ends of said straps, said switch member being operationally coupled to said microprocessor, wherein slack in tension in said straps actuates said switch member such that a first securing means is defined; and said actuating means being adapted for turning said first securing means on and off, wherein said speaker sounds an alarm if said first security device is turned on and said straps are removed from said suitcase.

4. The suitcase location and security system as in claim 3, further including:

a second security device, said second security device comprising a circuit, said circuit including a conduit extending outwardly of said housing, said conduit having a first end operationally coupled to said microprocessor and a second end having a male plug electrically coupled thereto, said male plug being removably insertable into a female plug extending into said front side of said housing, said female plug being operationally coupled to said microprocessor; and said actuating means being adapted for selectively turning said second security device on and off, wherein said speaker sounds an alarm if said second security device is turned on and said circuit is broken.

5. The suitcase location and security system as in claim 4, further including:

a transponder for sending a signal, said transponder being securely mounted in said housing and operationally coupled to said microprocessor, said transponder being adapted for emitting an unique signal for locating said housing.

6. The suitcase location and security system as in claim 3, further including:

a transponder for sending a signal, said transponder being securely mounted in said housing and operationally coupled to said microprocessor, said transponder being adapted for emitting an unique signal for locating said housing.

7. The suitcase location and security system as in claim 2, wherein said straps further comprise:

each of said straps being resiliently elastic, each of said straps having a break therein such that each of said straps has a first portion and a second portion removably coupled together with a fastening means.

8. The suitcase location and security system as in claim 1, further including:

a transponder for sending a signal, said transponder being securely mounted in said housing and operationally coupled to said microprocessor, said transponder being adapted for emitting an unique signal for locating said housing.

9. A suitcase location and security system, said system being removably mountable to a suitcase and a handle thereof, said system comprising:

a housing, said housing having a top surface, a bottom surface, a front side, a back side, a first side wall and a second side wall, said housing being generally hollow, said top surface of said housing having a plurality of holes therethrough, said top surface having a plurality of bar code indicia thereon, said bar code indicia being unique to said housing, said back surface having personal information indicia thereon;

a plurality of dials, each of said dials being rotatably coupled to a peripheral edge of said housing, each of said dials having airport indicia thereon for indicating a plurality of airports and flight numbers, each of said dials having a window associated therewith extending through said top surface;

a microprocessor, said microprocessor being adapted for sending a signal to a transponder, for actuating a plurality of lights, for sending a sound signal to a speaker, and for decoding a received signal, said microprocessor being securable mounted in said housing;

a power supply for powering said microprocessor, said power supply being operationally coupled to said microprocessor, said power supply being positioned in said housing, said power supply comprising a battery;

a speaker for emitting a sound, said speaker being securely mounted in said housing and positioned generally adjacent to said holes in said top surface;

a plurality of lights, each of said lights being mounted in and being generally flush with said top surface of said housing, each of said lights being electrically coupled to said microprocessor, each of said lights having a different color;

a receiving means for receiving a signal, said receiving means being securely positioned in said housing and operationally coupled to said microprocessor;

a transponder for sending a signal, said transponder being securely mounted in said housing and operationally coupled to said microprocessor, said transponder being adapted for emitting an unique signal for locating said housing;

a first security device, said first security device comprising a pair of straps, each of said straps having a first end and a second end, each of said first ends being securely attached to said first side wall, each of said second ends movably extending through said second side wall, a switch member being positioned in said housing and securely attached to each of said second ends of said straps, said switch member being operationally coupled to said microprocessor, wherein slack in said straps actuates said switch member, each of said straps being resiliently elastic, each of said straps having a break therein such that each of said straps has a first portion and a second portion removably coupled together with a fastening means, said fastening means comprising a hook and loop fastening means, wherein said straps are placeable around the suitcase;

a second security device, said second security device comprising a circuit, said circuit including a conduit extending outwardly of said housing, said conduit having a first end operationally coupled to said microprocessor and a second end having a male plug electrically coupled thereto, said male plug being removably insertable into a female plug extending into said front side of said housing, said female plug being operationally coupled to said microprocessor;

an actuating means for sending a signal to said receiving means, said actuating means being adapted for selectively turning said first and second security devices on and off and for turning said lights on and off, wherein said speaker sounds an alarm if said first security device is turned on and said straps are removed from said suitcase, wherein said speaker sounds an alarm if said second security device is turned on and said circuit is broken, said actuating means comprising a remote control device.

10. The suitcase location and security system as in claim 9, further including:

a card having credit and personal information thereon linking said bar-code indicia to said card; and a scanner adapted for scanning said information on said card and said housing.

11. A suitcase location and security system comprising:

a housing having an interior, an outer surface of said housing having bar code indicia marked thereon, said bar code indicia being unique to said housing;

at least one lights mounted on said housing;

a receiving means in said housing for receiving a signal and generating a received signal;

a microprocessor mounted in said housing and being operationally connected to said at least one light for actuating said at least one light and being operationally connected to said receiving means for decoding the received signal;

a means for coupling said housing to a suitcase;

an actuating means for sending a signal to said receiving means, said actuating means being adapted for selectively causing said at least one light to turn on and turn off, said actuating means permitting remote control of said microprocessor through said receiving means;

at least two dials being rotatably mounted on said housing, a first one of said dials having indicia marked thereon for indicating a plurality of airports, a second one of said dials having indicia marked thereon for indicating a plurality of flight numbers, each of said dials being positioned adjacent to a window formed in said housing for exposing a portion of said dial through said window to show one of said indicia.

12. The suitcase location and security system as in claim 11, wherein said means for coupling said housing to said suitcase comprises a strap for removably placing around the suitcase, said strap having a first end and a second end, said ends of said strap being secured to opposite locations on said housing.

13. The suitcase location and security system as in claim 12, wherein said system further includes:

a sound emitter mounted on said housing for emitting a sound and being operationally connected to said microprocessor;

the second end of said strap being removably connected to a switch member located in said housing, said switch member being operationally coupled to said microprocessor and being adapted for detecting slack in tension in said strap in a manner such that said microprocessor actuates said sound emitter when slack in tension in said strap is detected.

14. The suitcase location and security system as in claim 13, further including:

a secondary security device comprising a circuit including a conductive cord extending outwardly of said housing, said conductive cord having a first end fixedly coupled to housing and a second end of said conductive cord having a plug coupled thereto, said plug being removably insertable into a socket extending into said housing, said conductive cord and said socket being electrically connected to said microprocessor such that insertion of said plug into said socket closes said circuit through said conductive cord and removal of said plug from said socket or breakage of said conductive cord opens said circuit, said microprocessor being adapted to sound an alarm through said sound emitter if said circuit is broken.

15. The suitcase location and security system as in claim 1, further including:

a transponder for sending a signal, said transponder being mounted in said housing and being operationally coupled to said microprocessor, said transponder being adapted for emitting an unique audible signal for facilitating locating of said housing by a user.

* * * * *